United States Patent [19]

Focke et al.

[11] Patent Number: 4,509,310

[45] Date of Patent: Apr. 9, 1985

[54] APPARATUS FOR THE PRODUCTION OF PACKS, ESPECIALLY CIGARETTE CARTONS

[75] Inventors: Heinz Focke, Verden; Hugo W. Mutschall, Kirchlinteln, both of Fed. Rep. of Germany

[73] Assignee: Focke & Co., Verden, Fed. Rep. of Germany

[21] Appl. No.: 381,478

[22] Filed: May 24, 1982

[30] Foreign Application Priority Data

Jun. 13, 1981 [DE] Fed. Rep. of Germany ..... 3123496

[51] Int. Cl.[3] ..... B65B 11/32; B65B 41/18

[52] U.S. Cl. ..... 53/170; 53/234

[58] Field of Search ..... 53/234, 225, 228, 233, 53/586, 449, 466, 170, 176, 540

[56] References Cited

U.S. PATENT DOCUMENTS

| | | | |
|---|---|---|---|
| 3,253,387 | 5/1966 | Schmermund | 53/234 |
| 3,885,374 | 5/1975 | Schmermund | 53/234 |
| 3,924,386 | 12/1975 | Schmermund | 53/234 |
| 4,085,568 | 4/1978 | Focke et al. | 53/234 |
| 4,358,920 | 11/1982 | Kanai et al. | 53/234 X |

FOREIGN PATENT DOCUMENTS

| | | | |
|---|---|---|---|
| 149070 | 11/1936 | Austria | 53/466 |
| 632848 | 5/1934 | Fed. Rep. of Germany | 53/234 |
| 2361545 | 11/1974 | Fed. Rep. of Germany | 53/234 |
| 2149114 | 4/1976 | Fed. Rep. of Germany | 53/234 |

*Primary Examiner*—John Sipos
*Assistant Examiner*—Donald R. Studebaker
*Attorney, Agent, or Firm*—Sughrue, Mion, Zinn, Macpeak, and Seas

[57] ABSTRACT

Packs, especially large packs with several individual packs (cigarette cartons), are produced with different constructions, namely with different or, if appropriate, several outer wrappings (blanks). For the alternative production of different packs of this type in one and the same unit, there are several, especially two wrapping and folding units (folding turrets 15, 16), through which the pack content (pack group 11) passes jointly or alternatively depending on the form of the pack, and different blanks can be attached. On the outflow side of these wrapping and folding units there is a pack holder with a pack tower, and this pack holder can be connected alternatively to one or other wrapping and folding unit for receiving the packs.

10 Claims, 7 Drawing Figures

Figure 1:
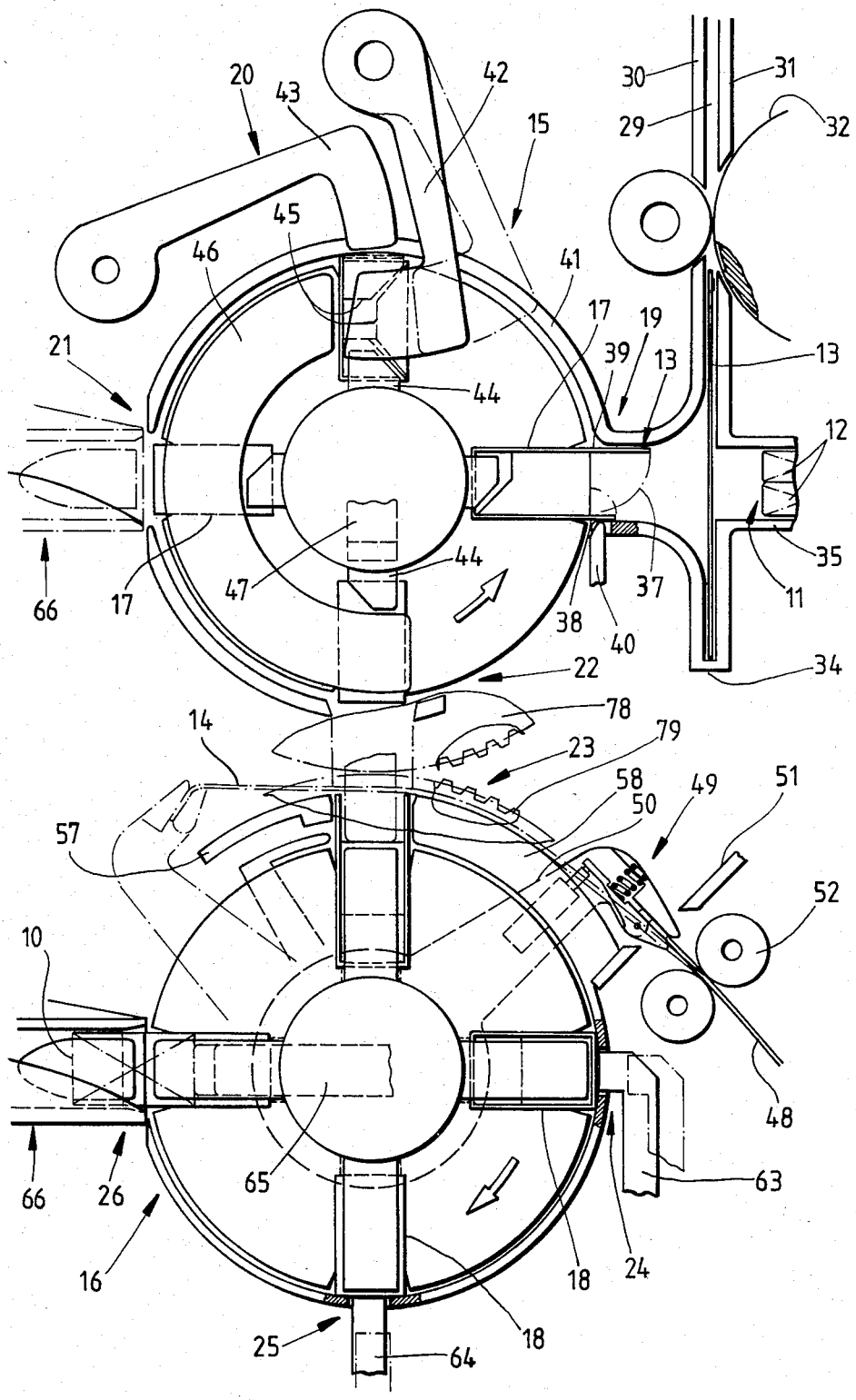

17
78
15
22
59
23
14
57
61
58
59
11
62
60
14
16
79
50
56
49
55
53
51
52
48
54
51
63
18
18

APPARATUS FOR THE PRODUCTION OF PACKS, ESPECIALLY CIGARETTE CARTONS

DESCRIPTION

The invention relates to an apparatus for the production of packs by wrapping articles in at least one blank, especially for the production of large packs consisting of pack groups (cigarette cartons containing several cigarette packs).

The production of large packs or cartons, so-called bundles, requires special packaging measures if adequate outputs are to be achieved despite the fact that the packs or cartons are conventionally of large volume. The invention is concerned with the production of packs of this kind, specifically especially so-called cigarette cartons, that is to say bundles consisting of a plurality of cigarette packs, usually 20. The subject of the invention is the design of an apparatus so that as regards the wrapper (blank) different types of packs or cartons can be produced in one and the same apparatus.

The object on which the invention is based is, therefore, to propose an apparatus for the production of packs, especially cartons or large packs, by means of which packs with different outer wrappers or with several wrappings can be made alternatively, without the apparatus having to be converted especially for this purpose.

To achieve this object, the apparatus according to the invention is characterised in that the articles or pack groups (groups of cigarette packs) for wrapping by blanks of different kinds or by several blanks alternatively pass through one of several wrapping and folding units or through several wrapping and folding units of this type in succession.

Accordingly, the apparatus according to the invention is equipped with several self-contained and complete devices for the production of a pack or carton, namely for wrapping and folding a blank or wrapper. Each of these wrapping and folding units is consequently capable of folding a blank so as to at least substantially wrap the pack contents. If, for example, a pack is to be provided with two wrappings (for example, a paper blank and a transparent film or plastic-foil blank), the article or the pack group passes in succession through two wrapping and folding units each of which attaches one of the blanks as a wrapping.

According to the invention, these wrapping and folding units are folding turrets which are arranged axis-parallel to one another, especially one under another.

A further fundamental proposal of the invention relates to devices located after the wrapping and folding units for receiving and ready-folding the large packs (cartons) and for collecting these. In particular, these devices are designed as a shaft-shaped or tunnel-shaped pack holder adjoining the folding turrets and having an integrated collecting tower located above it for the large packs. It is envisaged, according to the invention, that only one device of this type (a pack holder with a collecting tower) should be assigned to several, especially two, folding turrets and should be mounted adjustably in such a way that, depending on the types of large packs to be produced, this device can be positioned alternatively adjoining one or the other of the folding turrets.

Further features of the invention relate to the design of the folding turrets, to measures for feeding blanks and to the arrangement and design of the pack holder or collecting tower.

Figure 2:
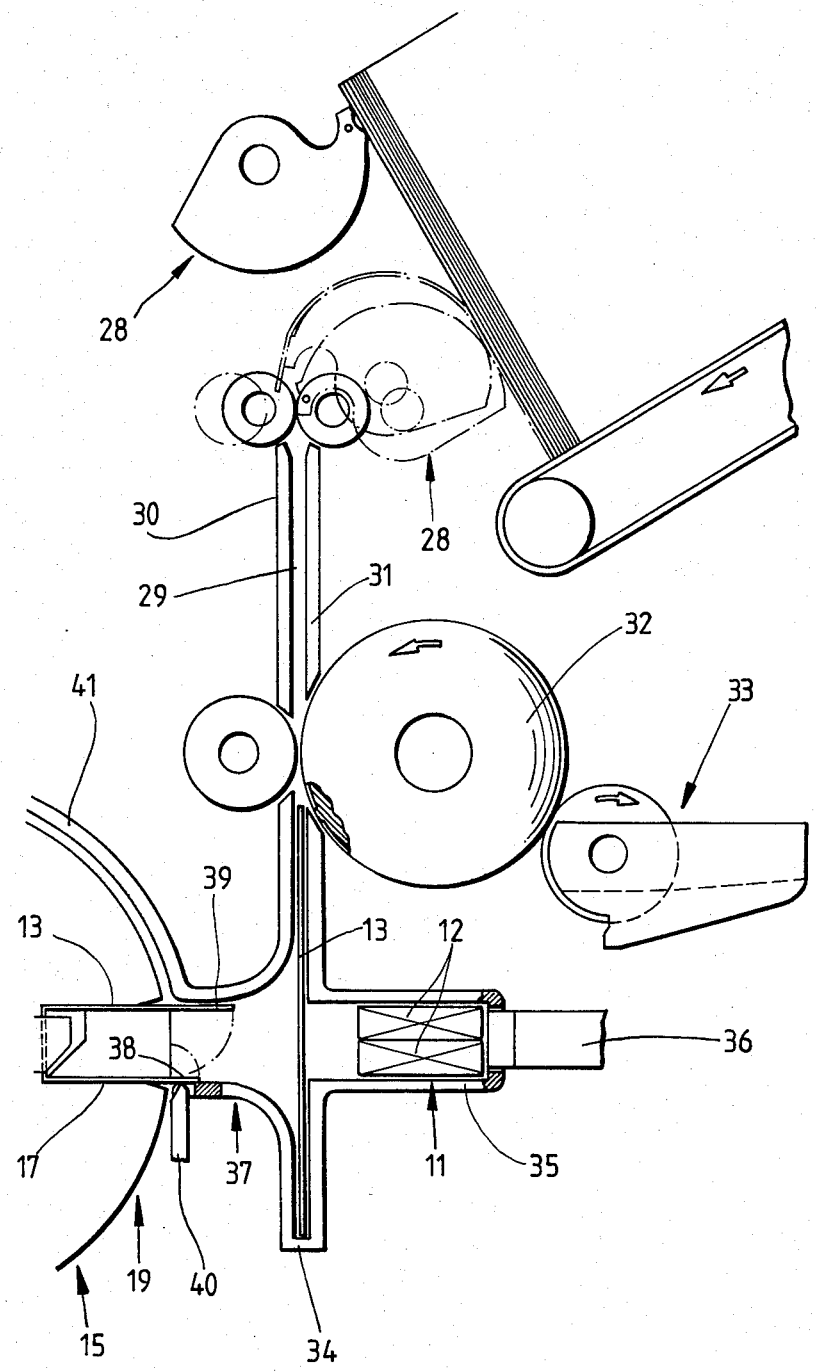
Figure 3:
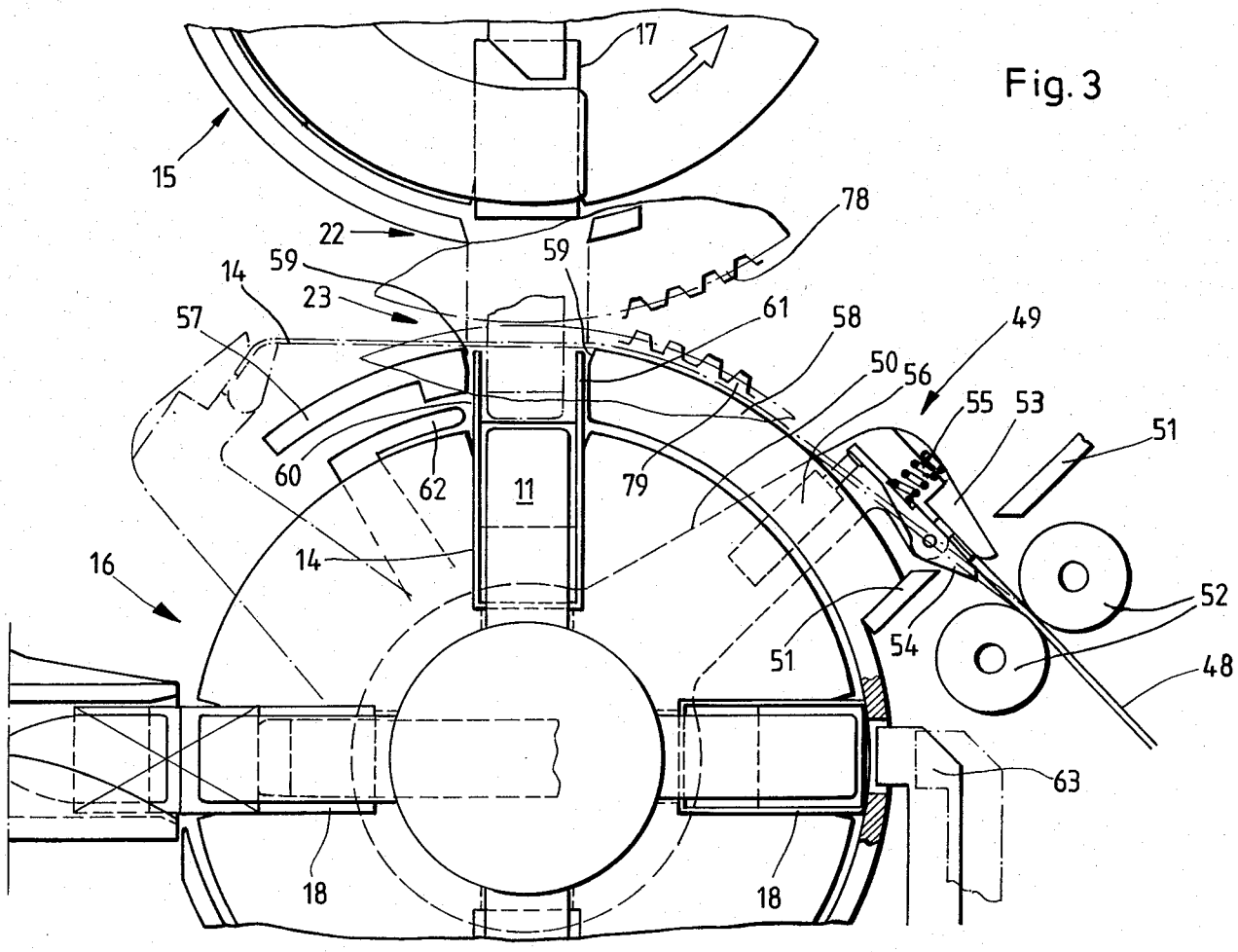
Figure 4:
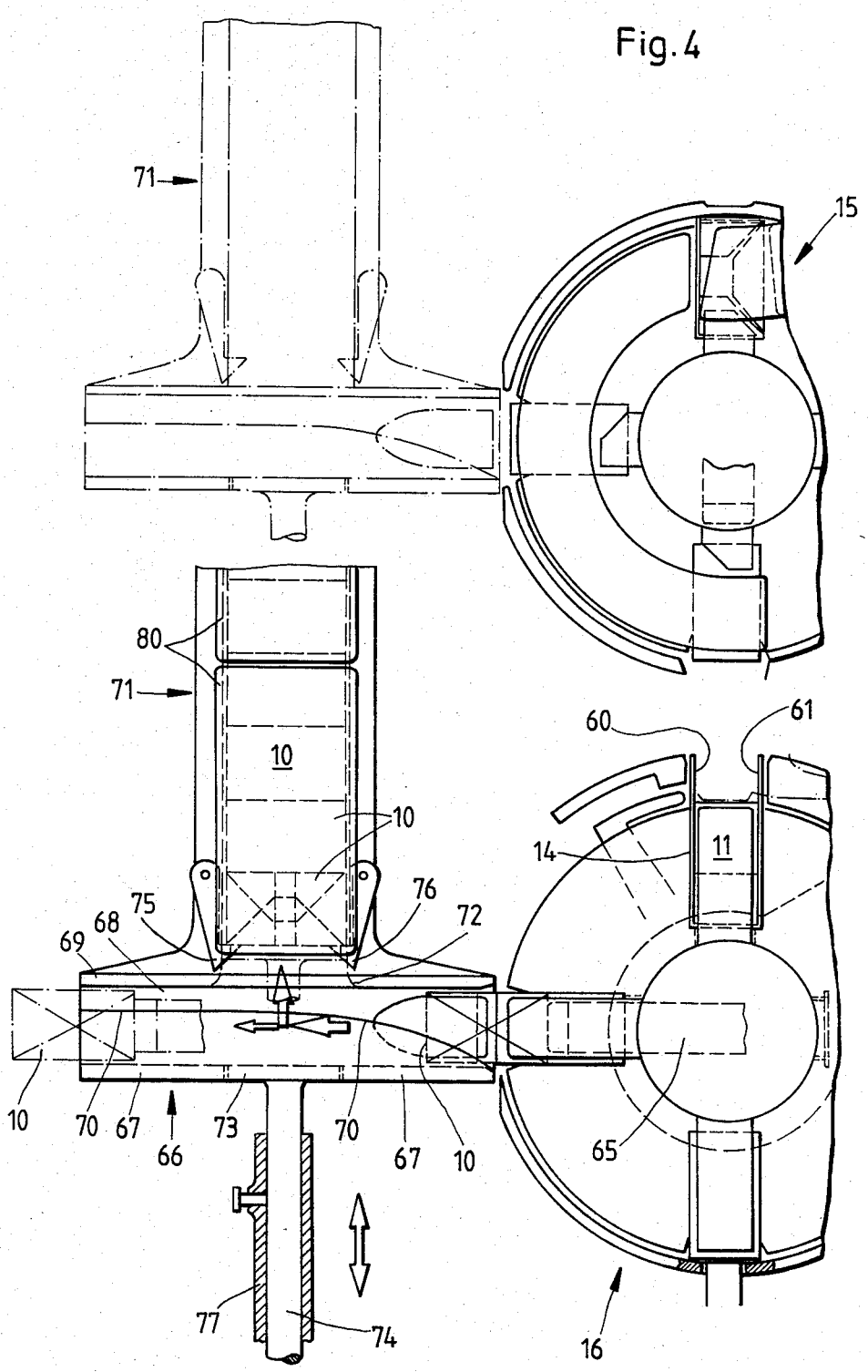
Figure 5:
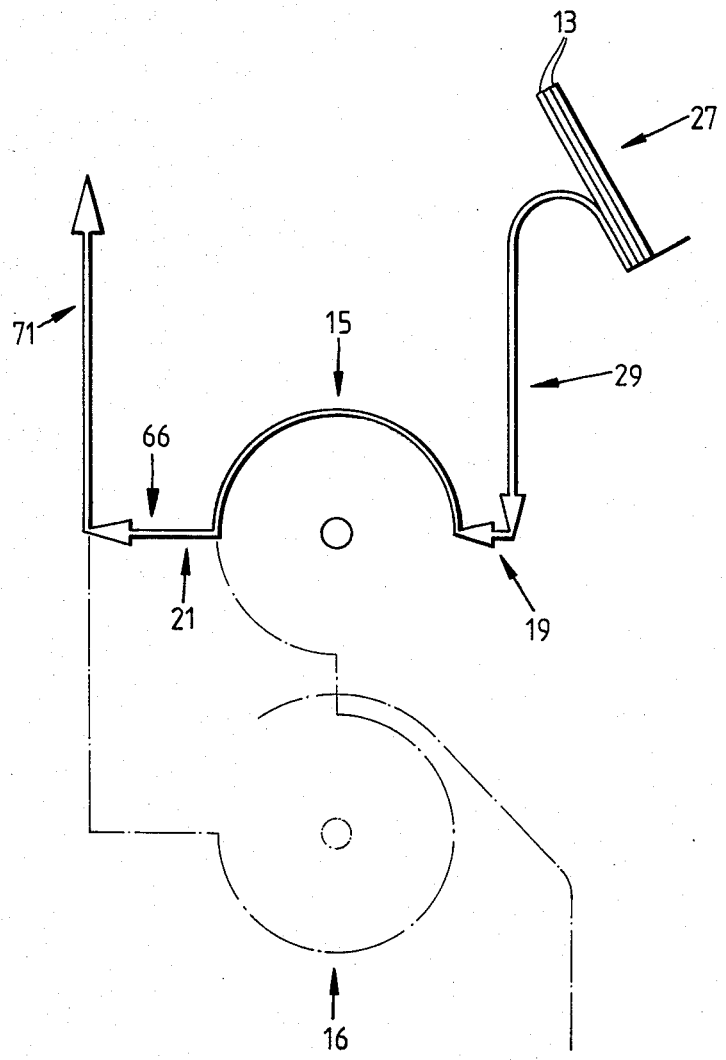
Figure 6:
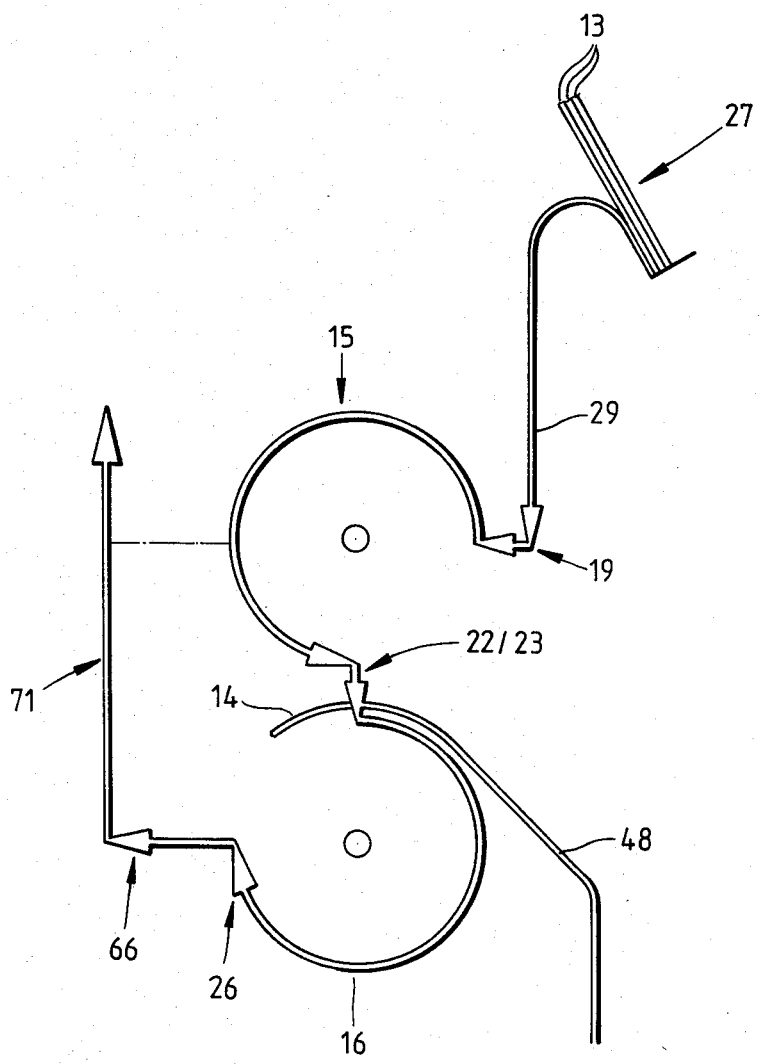
Figure 7:
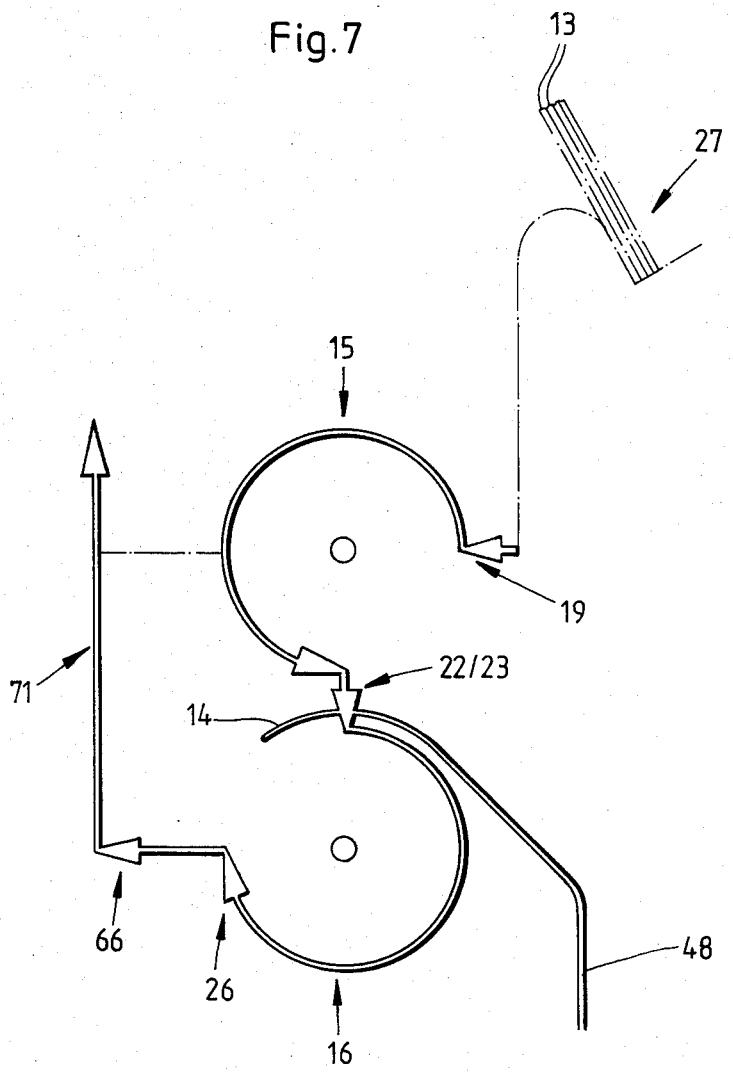

An exemplary embodiment of the invention is explained in more detail below with reference to the drawings in which:

FIG. 1 shows, in a diagrammatic side view, part of an apparatus for wrapping a pack group alternatively with one or two blanks, FIG. 2 shows, in a side view, a detail of the apparatus, namely the region of the feed of a first blank, FIG. 3 shows, on an enlarged scale, a detail in the region of the transfer of packs from one folding turret to the other, FIG. 4 shows, also in a side view, the region where the large packs formed emerge from the wrapping and folding units, FIG. 5 to FIG. 7 show transport diagrams relating to the cycle of movement during the production of alternative large packs using the apparatus according to FIGS. 1 to 4.

The exemplary embodiment illustrated shows an apparatus for the production of large packs 10 each consisting of a pack group 11. In the present case, this consists, in turn, of a plurality of individual packs, namely cigarette packs 12, so as to form a so-called cigarette carton.

To form the large pack 10, the pack group 11 is alternatively wrapped in one blank only, namely in a paper blank 13, or additionally in a foil film blank 14 which, in the case of designs with two wrappings, forms the outer wrapping.

For wrapping the pack group 11 with the paper blank 13 and, if appropriate, with the foil blank 14, there are wrapping and folding units in the form of folding turrets 15 and 16 which are assigned to each blank. Here, these are arranged one above another, axis-parallel to one another, with their axis of rotation directed horizontally. The folding turrets 15 and 16 are moved in a timed sequence and thus carry out folding operation on the large packs 10 to be formed or on the blanks 13, 14.

Each folding turret 15, 16 is provided with four pockets 17, 18, each for receiving a pack group 11. The pockets 17, 18 are offset 90° relative to one another. The folding turrets 15, 16 are moved correspondingly in a timed sequence. During this time, the pockets 17, 18 pass through stations in which specific measures are carried out.

In the first folding turret 15, the pack group is pushed in in the region of a pushing-in station 19 to the extent of the pocket 17 made ready here and open on the radially outer side. The folding turret 15 rotated in an anticlockwise direction then transports the pack group 11, together with a paper blank 13, into a folding station 20. After a further phase of movement along a quarter circle, the large pack 10 now formed passes into a pushing-out station 21. If the large pack 10 is to be wrapped with a further blank (foil blank 14), transport by the folding turret 15 continues to a further station, namely to the transfer station 22. This is located immediately above the folding turret 15 and at a short distance from this. The relative position is such that a pocket 18 open upwards receives, in the region of a take-up station 23 of the folding turret 16, the large pack 10 provided with the first blank (paper blank 13), as result of a movement directed radially or downwards.

The folding turret 16 likewise passes through a plurality of stations, specifically in a clockwise direction. A first sealing station 24 and a second sealing station 25 serve for fixing by means of (thermal) sealing the foil blank 14 surrounding the large pack 10. There follows a pushing-out station 26. During the intermittent movement of this folding turret 16, folds are likewise made, especially in the region of end faces directed laterally.

In the exemplary embodiment illustrated, the (first) paper blank 13 is extracted from a blank-magazine 27 of known design. Individual paper blanks 13 are extracted from this blank-magazine 27 by means of a dispenser 28 which grasps a paper blank 13 at an end region, carries it along as result of rotation about its own axis and feeds it to a blank-channel 29. The construction and mode of operation of this dispenser 28 are known as a transfer member for blanks.

The vertical blank-channel 29 serves for guiding the paper blank 13 up to the pushing-in station 19 of the folding turret 15. The blank-channel 29 consists of two guide walls 30 and 31 which are arranged at a distance from one another and between which the paper blank is conveyed and retained in a vertical plain. There projects into the path of movement of the paper blank 13 within the blank-channel 29 a glue-coating roller 32 which receives a glue pattern from a glue appliance 33 and which transfers this to the paper blank 13.

At the lower end of the blank-channel 29 a stop or support for the paper blank 13 is formed by a web 34, so that the paper blank is retained in an exact relative position in relation to the pushing-in station 19 or the pocket 17 located therein. The pack group is pushed off and into the pocket 17 from a transversely directed pack track 35 which is connected here to the blank-channel 29. This pushing-in is carried out by an appropriately movable slide 36. During the pushing-in movement, the pack group 11 passes through the plain of the paper blank 13 and takes this along with it. The paper blank 13 thus wraps itself in a known way around the pack group 11 in the form of a U. This first folding operation is assisted by an arcuate inlet mouthpiece 37.

After the pack group 11, together with the paper blank 13, has been pushed in, longitudinal tabs 38 and 39 projecting radially outwards are folded in succession, specifically the (shorter) longitudinal tab 38 at the rear in the direction of rotation being folded first by a folder 40. The other longitudinal tab 39 is folded over as a result of the relative movement of the paper blank 13 (together with the pack group 11) in relation to a fixed outer guide 41.

In the region of the folding station 20, movable folding fingers 42 and 43 are arranged laterally next to the folding turret 15, and, interacting with a fixed folding web 44, these fold at least partially end tabs 45 projecting laterally. A fixed end guide 46 next to the folding turret 15 fixes the end fold made in the folding station 20 or folds over one of the end tabs 45 as a result of the relative movement.

Consequently, in the region of the following pushing-out station 21 more or less finished large packs 10 are pushed in a radial direction out of the particular pocket 17.

If the large packs 10 are to be wrapped (additionally with the foil blank 14), transport is continued into the transfer station 22. By means of a slide 47 movable up and down, the large packs 10 pass from the pocket 17 into an upwardly directed pocket 18 of the folding turret 16 in the region of the take-up station 23.

Here, the foil blank 10 is made ready in a similar way to the paper blank 13, that is to say in such a way that as a result of the pushing-in movement of the large pack 10 the foil blank 14 is folded round the large pack 10 in the form of a U.

Here, the foil blank 14 is severed from a continuous foil sheet 48 before transfer. For this purpose, the foil sheet 48 is conveyed intermittently to the extent of a portion corresponding to the foil blank 14. Tongs 49 serve as a conveying member here, and these grasp the free end of the foil sheet 48 and transport it along an arcuate portion. The tongs 49 are arranged on a pivoting arm 50 which is mounted co-axially to the folding turret 16, that is to say it describes a concentric circular arc. The movement extends over an angle of 90°, specifically approximately 45° on each side of the pocket 18 in the region of the take-up station 23. In the drawings, the end position of the tongs 49 when the foil sheet 48 is grasped is shown by unbroken lines, and the opposite end position in which the foil blank 14 covers the access to the pocket 18 is shown by dot-and-dash lines. In this position, the foil blank 14 is severed from the foil sheet 48 by severing knives 51. Retaining rollers 52 equipped with a free-wheel prevent the foil sheet 48 from being pulled back. The free end of the latter is, instead, kept ready in a position suitable for the tongs 49.

The tongs 49 are designed with two clamping jaws 53 and 54, the clamping jaw 54 of which can be held in the closing position by a compression spring 55 and can be moved into the opening position by a pressure-medium cylinder 56.

The (radially outer) opening side of the pocket 18 in the region of the take-up station 23 is provided with supporting members for the foil sheet 48 or the foil blank 14, specifically in the form of fixed supporting plates 57 and 58 in the form of circular arcs. These leave a push-through orifice 59 free for the large pack 10 (coming from above). The foil blank 14 placed transversely over the push-through orifice 59 is carried along by the large pack 10 in the way described.

The folding members of the folding turret 16 are essentially of conventional type. Tubular tabs 60 and 61 projecting on the radially outer side are folded over against the associated pack sides by a folding finger 62, on the one hand, and be a fixed outer guide formed by the supporting plate 58. Folding members in the form of the folding turret 15 can be provided for the end folds. An alternative solution yet to be described is illustrated in the drawings.

The tubular tabs 60, 61 are connected to one another by thermal welding in the region of the sealing stations 24 and 25 by means of sealing jaws 63 and 64.

In the region of the pushing-out station, the largely finished large pack 10 is pushed out of the respective pocket 18 by an ejector 65 working radially.

Connected to the wrapping and folding units (folding turrets 15,16) is a take-up unit for the large packs 10, the construction and arrangement of which are of special importance.

Immediately adjoining the pushing-out station 26, a shaft-shaped or tunnel-shaped pack holder 66 follows on the same conveying plane for the large packs 10. In the present case, this pack holder is directed horizontally and consists of a conveying wall 67 at the bottom, side walls 68 and an upper wall 69. The large packs 10 rest on the conveying wall 67. In the region of the side walls 68, so-called folding deflectors 70 are formed here, and these carry out the folding of end tabs of the foil blank 14.

The vertical pack tower 71 adjoins this pack holder 66 approximately centrally. This pack tower is connected to the pack holder 66 via the upper wall 69. An orifice 72 in the upper wall 69 makes it possible to convey the large packs 10 into the pack tower 71 by appropriate lifting. For this purpose, a lifting plate 73 is inserted flush in the conveying wall 67 in the region of the conveying wall 69 at the bottom. This lifting plate 73 rests on the top end of a lifting rod 74. By moving the latter upwards, a large pack 10 resting on the lifting plate 73 is moved upwards into the pack tower 71.

In the pack tower 71, the large packs 10 resting on top of one another are retained by supporting members, specifically by pivotable supporting brackets 75 and 76 which grasp by means of one supporting leg the underside of the particular lower large pack 10. By being pivoted sideways, these supporting brackets 75, 76 are moved to the side when the next large pack 10 is pushed in, so that it can be introduced into the pack tower 71, with the large packs 10 already collected therein being lifted. The lifting plate 73 is then lowered again. As shown by dot-and-dash lines on the left in FIG. 4, incorrect packs are pushed through the pack holder 66 without being received in the pack tower 71.

The pack tower 71 is provided on sides located opposite one another, namely in the region of the end faces of the large pack 10 with heating plates 80 which cause sealing of the previously folded end tabs in the region of the end faces.

A special feature is that the pack holder 66 can be used as a common member for both (or several) wrapping and folding units (folding turrets 15,16), that is to say, alternatively, it can be connected to one or the other folding turret 15,16. The lower position of the pack holder 66 adjacent to the folding turret 16 is shown by unbroken lines. By lifting this unit, the pack holder 66 (with the pack tower 71) can be assigned to the (upper) folding turret 15. For this purpose, the lifting rod 74 rests in a guide sleeve 77 which is moved up and down appropriately to carry out change-overs as described above. The lifting rod 74 is displaceable within this guide sleeve 77 for the lifting of large packs. The guide sleeve 77 is mounted in the various positions on a suitable supporting structure not shown in detail.

The apparatus thus described makes it possible to meet different requirements as regards the construction and production of large packs 10. The functional cycles and paths of movement are illustrated diagrammatically in detail in FIGS. 5 to 7.

The material flow, specifically the path of movement of the blanks 13, 14 and of the pack group 11 or the large pack 10 are represented in these illustrations by a double line with a directional arrow.

The illustration according to FIG. 5 relates to the production of large packs which are wrapped only in a paper blank 13, that is to say in a single blank. Here, the blank and the pack group pass only through the first folding turret 15 and then enter the pack holder 66 and the pack tower 71.

In the design according to FIG. 6, the large packs 10 are provided with two wrappings, that is to say especially a paper blank and a foil blank. The pack group runs through both folding turrets 15 and 16 in the way described and passes out from the folding turret 16 into the pack tower 71.

Finally, the alternative according to FIG. 7 can be carried out. Here, the pack group is conveyed by the fixed pack track 35, without wrapping, into the first folding turret 15. This serves, here, merely as an intermediate transport member for transferring the cigarette group to the folding turret 16. This wraps the pack group in a single blank, especially a foil blank, and transfers the large pack 10 thus formed to the pack tower 71 in the way described.

The apparatus can also be equipped with further wrapping and folding units according to requirements.

Instead of the shiftable unit consisting of the pack holder 66 and pack tower 71, alternative solutions are also possible, which are such that, for example, a separate pack holder is assigned fixedly to each folding turret 15 and only the pack tower is shiftable and can be connected alternately to one or other pack holder.

In the exemplary embodiment illustrated, the exact synchronous movement of the folding turrets 15, 16 is guaranteed because these are engaged mutually with one another via gear wheels 78 and 79 which are arranged concentrically to the folding turrets 15, 16 and which mesh directly with one another as a result of appropriate dimensions.

We claim:

1. An apparatus for selectively wrapping groups of cigarette packs with first and second carton-forming wrapper blanks to form a carton of cigarette packs, and for discharging cartons wrapped in only the first wrapper blank, in only the second wrapper blank or in both the first and second wrapper blanks, said apparatus comprising:

first (15) and second (16) rotatable wrapping-and-folding turrets disposed one above the other with their rotational axes parallel to each other;

first feeding means for feeding first wrapper blanks (13) to said first turret (15);

second feeding means for feeding second wrapper blanks (14) to said second turret;

first discharge means in said first turret for discharging wrapped cartons at a first discharge station (21);

second discharge means in said second turret for discharging wrapped cartons at a second discharge station (26); and wrapped carton receiving means (66), movable between said first and second discharge stations, for selectively receiving wrapped cartons from said first and second discharge stations.

2. An apparatus as claimed in claim 1 further comprising means for rotating said first and second turrets in synchronism and in opposite rotational directions.

3. An apparatus as claimed in claim 2 wherein said first discharge station is spaced at a rotational angle of 180° from said first feeding means, and further comprising transfer means, located at a transfer station (22) spaced at a rotational angle of 270° from said first feeding means, for transferring groups of cigarette packs, with or without said first wrapper blanks (13), from said first turret to said second turret; whereby groups of cigarette packs discharged at said first discharge station (21) are wrapped in only said first wrapper blank, and groups of cigarette packs discharged at said second discharge station are wrapped in only said second wrapper blanks (14) or in both said first (13) and second (14) wrapper blanks.

4. An apparatus as claimed in claim 3 wherein each of said turrets comprises four pockets for holding said groups of cigarette packs, said pockets being spaced apart by 90° so that, at said transfer station (22), a pocket (17) in said first turret and a pocket (18) in said second turret are directly opposite each other and in communication with each other.

5. An apparatus as claimed in claim 4 further comprising means (57, 58, 59) on said second turret (16) for holding a second wrapper blank (14) between said directly opposite pockets (17, 18) at said transfer station (22).

6. An apparatus as claimed in claim 5 wherein said second wrapper blanks (14) are cut from a continuous sheet (48), and wherein said second feeding means comprises severing means (51) for cutting said sheet (48) and clamp means (49) for conveying said second wrapper blanks to said transfer station (22) between said directly opposite pockets.

7. An apparatus as claimed in claim 1 further comprising means (77) for moving said carton receiving means (66) between said first (21) and second (26) discharge stations.

8. An apparatus as claimed in claim 7 wherein said carton receiving means comprises folding means (70) for folding the end tabs of said second wrapper blanks (14).

9. An apparatus as claimed in claim 7 wherein said carton receiving means comprises a tower (71) extending vertically upward, and carton-lifting means (73, 74) for inserting wrapped cartons into said tower to produce a stack of cartons in said tower.

10. An apparatus as claimed in claim 9 wherein said moving means (77) is a sleeve, and said lifting means comprises a lifting plate (73) mounted on a rod (74) slidable in said sleeve (77).

* * * * *